US005237704A

United States Patent [19]

Phippen

[11] Patent Number: 5,237,704

[45] Date of Patent: Aug. 24, 1993

[54] DUAL ADJUSTABLE CANTILEVER FOR SHOULDER PADS

[75] Inventor: Reginald C. Phippen, Salt Lake City, Utah

[73] Assignee: Easton Sports, Burlingame, Calif.

[21] Appl. No.: 870,824

[22] Filed: Apr. 20, 1992

[51] Int. Cl.[5] ..... A61F 5/02

[52] U.S. Cl. ..... 2/45; 2/44; 2/267; 2/268

[58] Field of Search ..... 2/2, 44, 45, 267, 268

[56] References Cited

U.S. PATENT DOCUMENTS

| | | | |
|---|---|---|---|
| 3,017,639 | 1/1962 | Foley | 2/2 |
| 3,127,614 | 4/1964 | Bennett | 2/2 |
| 4,547,905 | 10/1985 | LaPorta, Jr. | 2/2 |
| 4,679,253 | 7/1987 | Mitchell et al. | 2/2 |
| 4,680,814 | 7/1987 | Mitchell et al. | 2/2 |
| 4,698,845 | 10/1987 | Cosby | 2/2 |
| 4,872,216 | 10/1989 | Wingo, Jr. | 2/2 |
| 5,129,101 | 7/1992 | Douglas | 2/2 |

*Primary Examiner*—Clifford D. Crowder
*Assistant Examiner*—Gloria Hale
*Attorney, Agent, or Firm*—Flehr, Hohbach, Test, Albritton & Herbert

[57] ABSTRACT

A shoulder pad assembly for protecting the upper body and shoulders. The shoulder pad assembly includes a substantially rigid outer shell having left and right body members. Each of the body members has a generally horizontally disposed arched portion for spanning one of the shoulders. A chest plate portion and a back plate portion depend from the arched portion. The shoulder pad assembly also includes a cantilever support extending between the plate portions for supporting the outer shell above the shoulders to substantially reduce the impact of the outer shell on the shoulders. The cantilever support is configured to support the outer shell above the trapezius muscle such that, when the muscle is substantially developed, the generally horizontally disposed arched portion is evenly supported on the trapezius muscle by the cantilever support.

23 Claims, 3 Drawing Sheets

DUAL ADJUSTABLE CANTILEVER FOR SHOULDER PADS

BACKGROUND OF THE INVENTION

1. Field of the Invention

In general, the present invention relates to shoulder pads worn for protection during football and other contact sports. More particularly, the present invention relates to an adjustable cantilever for shoulder pads.

2. Description of the Prior Art

When participating in contact sports such as football, athletes wear shoulder pads and other protective equipment to reduce the risk of injury. Most players aggressively use their shoulder pads to increase the force of contact when blocking, tackling or hitting the other athletes. Thus, a substantial amount of force is exerted on a player's shoulder pads while he is participating in the game.

Shoulder pads consist of a hard outer shell which generally covers the shoulders and upper body of the athlete. Padding within the rigid shell reduces the impact of forces encountered during blocking or tackling and the amount of contact between the outer shell and the upper body. During particularly aggressive hits, the padding does not offer sufficient protection and the outer shell is painfully forced against the shoulders. To provide further protection, cantilever straps often extend across the shoulders to hold the outer shell away from the player's body even during the more forceful contacts.

An increasing number of athletes are following intense training programs to improve their ability and performance. These players lift weights to fully develop their muscles while increasing their body mass and strength. Through this training the athletes attain body shapes of enlarged proportions. The trapezius muscle, when fully developed, becomes substantially enlarged. Instead of being generally horizontal, the athlete's shoulders develop a substantial slope from the top of the neck to the acromioclavicular joint. Essentially, the overly-developed trapezius muscle creates the visual impression of an athlete having no neck.

Shoulder pads are intended for athletes with the average body shape, they are not designed to accommodate the different body proportions which result from an aggressive weight training program. The arched portion of the outer shell is generally horizontally disposed. Since the surface of the shoulder has a substantial incline, the cantilever straps will not completely support the horizontal surface of the outer shell above the shoulders. During aggressive hits, a portion of the rigid shell will be painfully forced against the trapezius muscle. Thus, the effectiveness of the cantilever straps in providing protection for the shoulders from harmful impact by the outer shell is substantially reduced.

Shoulder pads which may be evenly supported above a shoulder independent of the slope of the trapezius muscle are highly desirable. Since athletes having the larger body proportions generally play at positions involving significant body contact, shoulder pads which more fully protect the shoulder and upper body by accommodating their different body shape would be particularly valuable. Since the degree of muscle development varies with the individual athlete, an adjustable cantilever support for evenly supporting the outer shell above the shoulders is especially desirable.

When supporting the outer shell above the shoulders, the cantilever straps transfer a substantial amount of the force of impact from the outer shell to the acromioclavicular joint. Many players have suffered serious injuries to the shoulder at this area during particularly forceful contacts with other players. As a result, various attempts have been made to develop cantilever straps which do not concentrate the force of impact on the acromioclavicular joint.

An example of a shoulder pad having cantilever straps designed for reducing the pressure exerted on the acromioclavicular joint is disclosed in U.S. Pat. No. 4,872,216 to Wingo. The central portion of the cantilever strap which covers the acromioclavicular joint has a width substantially greater than two inches. This increased width provides a larger area over which to disperse the force of impact, reducing the magnitude of force exerted on the acromioclavicular joint. The strap disclosed in Wingo protects the acromioclavicular joint by dispersing the impact over a greater area, reducing the amount of force imposed on the joint. A cantilever strap which transfers the force of impact to an area of the shoulder remote from the acromioclavicular joint would provide a greater amount of protection, and is therefore highly desirable.

U.S. Pat. No. 3,127,614 to Bennett discloses another example of a shoulder pad having cantilever straps particularly suitable for protecting the acromioclavicular joint. The cantilever elements include recesses shaped to provide clearance for the acromioclavicular joints and the clavicle bones, providing protection from impact. The cantilever strap covers the shoulder, with the strap recess isolating the acromioclavicular joint from the force of impact, preventing injury to the shoulder. While the strap taught by Bennett does provide significant protection for the shoulder, there remains the risk of impact between the walls of the recess and the acromioclavicular joint when a substantial force is exerted on the outer shell. A shoulder pad having a cantilever strap which more completely isolates the acromioclavicular joint from the force of impact would be particularly useful.

Other methods have been deployed for reducing the force of impact on the shoulder by the cantilever strap. In U.S. Pat. No. 3,017,639 to Foley, springs have been attached to the cantilever strap for absorbing the force of impact. Alternatively, a system of arches may be used to support the outer shell above the shoulders. Examples of shoulder pads having cantilever arch systems are disclosed in U.S. Pat. No. 4,547,905 to LaPorta and U.S. Pat. No. 4,680,814 to Mitchell et al. With both the spring and arch systems, the cantilever support absorbs a portion of the force of impact. In the truss arch system disclosed in U.S. Pat. No. 4,679,253 to Mitchell et al. the force of impact is dispersed across the shoulders. The cantilever support protects the shoulders from injury, however the force of impact may not sufficiently absorb or disperse the force of impact. Shoulder pads having a cantilever support which transfers the force of impact to an area of the shoulder which is remote from the acromioclavicular joint, thereby providing a greater degree of protection, is especially desirable.

The cantilever supports available in the prior art are designed for players having the average body shape, not for the athletes with overly-developed muscles. Since the cantilever straps do not evenly support the outer shell above a shoulder having a sloped surface, the effectiveness of the cantilever straps in protecting the acromioclavicular joint from injury is substantially reduced. Thus, a cantilever support for shoulder pads which will evenly support the outer shell above a sloped shoulder surface while protecting the acromioclavicular joint from injury would be particularly valuable.

SUMMARY OF THE INVENTION

Accordingly, a primary object of the present invention is to provide a cantilever support for a shoulder pad assembly which evenly supports the outer shell independent of the slope of the trapezius muscle.

A further object of the present invention is to provide a cantilever support for a shoulder pad assembly which transfers the force of impact to an area of the shoulders remote from the acromioclavicular joint.

Another object of the present invention is to provide a cantilever support for a shoulder pad assembly which evenly supports the outer shell above the shoulders.

Yet another object of the present invention is to provide a cantilever support which minimizes the risk of injury from the forceful contact between the cantilever support and the acromioclavicular joint.

A general object of the present invention is to provide a cantilever support for a shoulder pad assembly which accommodates different body shapes to more effectively protect the shoulders and upper body of an athlete from injury.

A more general object of the present invention is to provide a shoulder pad assembly which reduces the impact of forces encountered during blocking or tackling on the upper body while protecting the shoulders from injury.

In summary, the shoulder pad assembly of the present invention includes a substantially rigid outer shell having left and right body members. Each body member includes a generally horizontally disposed arched portion for covering the shoulder, and chest and back plate portions depending from the arched portions. The left and right body members fit over and protect the upper body and shoulders of an athlete.

The shoulder pad assembly also includes a cantilever support extending between the plate portions to support the arched portion above the shoulders, substantially reducing the impact of the outer shell as it is pressed against the shoulders by externally applied forces. The cantilever support is configured to support the outer shell above the surface of the shoulders such that, when the trapezius muscle is substantially developed, the generally horizontally disposed arched portion is evenly supported on the trapezius muscle by the cantilever support.

In one embodiment of the present invention, the cantilever support includes first and second strap portions, one of which may be lengthened while the other is shortened to adjust the arch of the strap portions relative to the slope of the shoulder surface. In another embodiment of the present invention, the cantilever support is further configured for transferring externally applied forces from the outer shell to an area of the shoulder remote from the acromioclavicular joint.

BRIEF DESCRIPTION OF THE DRAWINGS

Additional objects and features of the present invention will be more apparent from the following detailed description and the appended claims, when taken in conjunction with the drawings, in which:

DETAILED DESCRIPTION OF THE INVENTION

Figure 1:
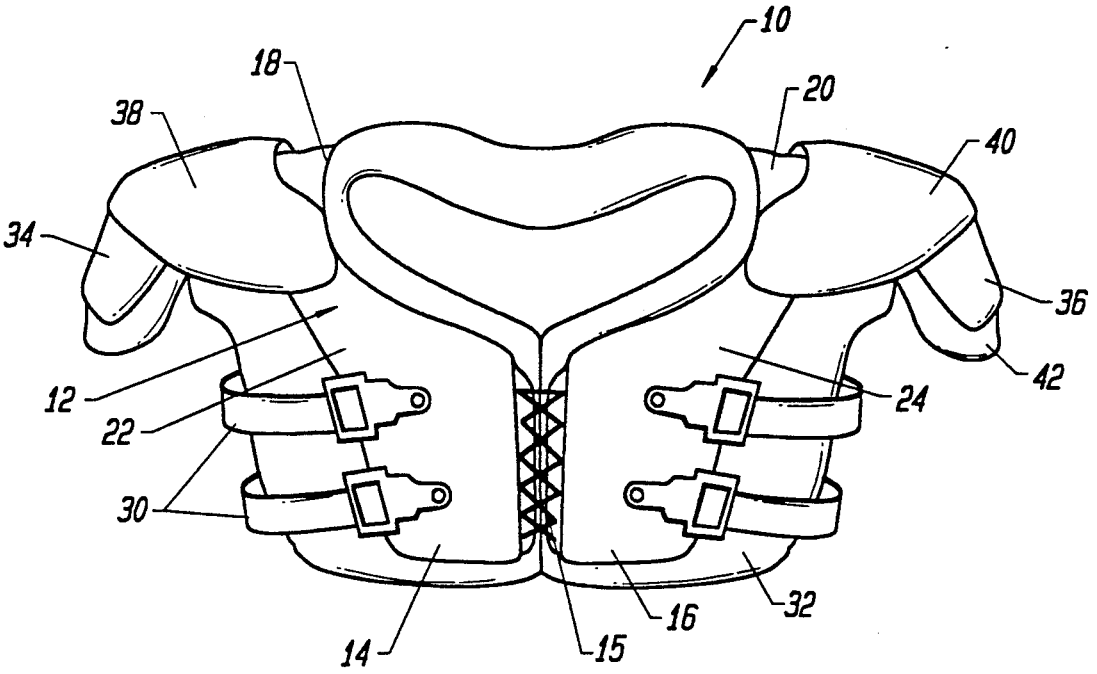
FIG. 1 is a front view of a shoulder pad assembly in accordance with the present invention.

Reference will now be made in detail to the preferred embodiment of the invention, which is illustrated in the accompanying figures. Turning now to the drawings, wherein like components are designated by like reference numerals throughout the various figures, attention is directed to FIGS. 1–3.

Figure 2:
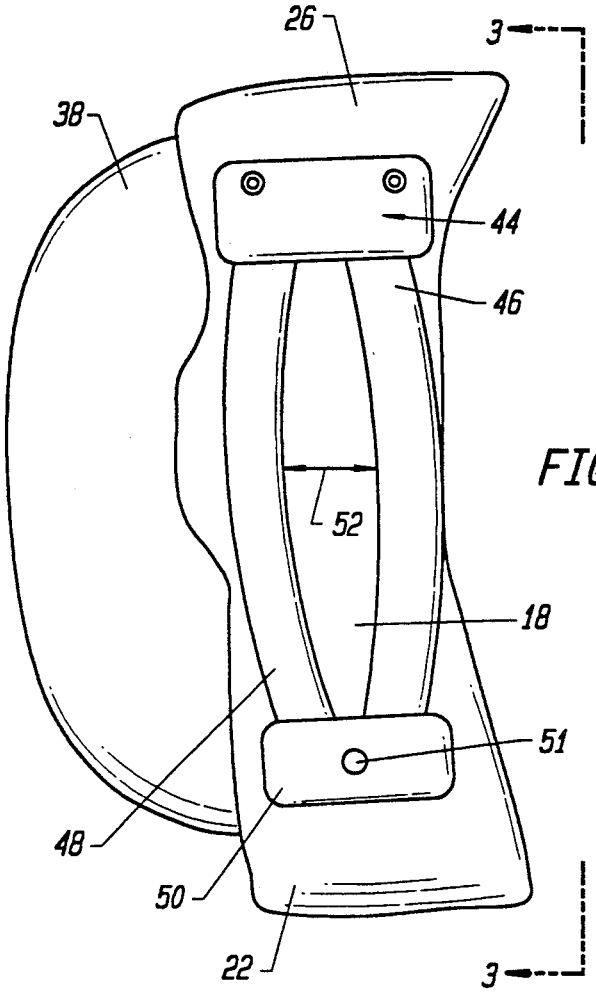
FIG. 2 is bottom plan view showing a cantilever support of a shoulder pad assembly in accordance with the present invention.
Figure 3:
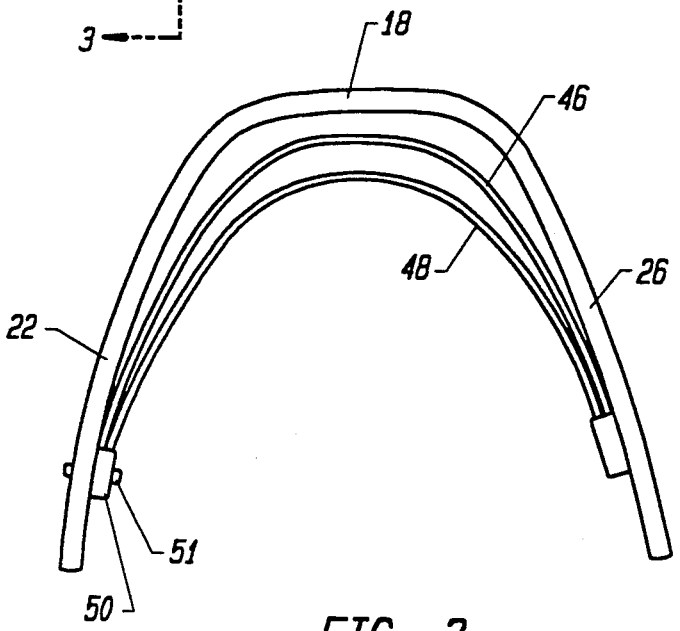
FIG. 3 is an view of the cantilever support of shoulder pad assembly taken along line 3—3 of FIG. 2.

A shoulder pad assembly 10 incorporating the present invention is shown in FIGS. 1–3. The shoulder pad assembly generally includes a substantially rigid outer shell 12 having left and right body members 14 and 16. The body members have arched portions 18 and 20 which span each of the shoulders (not shown). As with conventional shoulder pads, the arched portion is generally horizontally disposed. Chest plate portions 22, 24 and back plate portions 26 depend from the arched portions to cover and protect the upper body of the athlete. Body members 14 and 16 are connected together using methods well known in the art, such as lacing 15 between chest plate portions 22 and 24 and rivets (not shown) securing back plate portions together. To retain the proper positioning of shoulder pad assembly 10 when worn by the player, adjustable straps 30 connect the chest plate portions to the back plate portions.

To reduce the impact of blows delivered during blocking or tackling, padding 32 is attached within outer shell 12. The padding absorbs a portion of the impact, and cushions the shoulders and upper body from the rigid outer shell. Shoulder caps 34, 36 protect the deltoid muscle area of the shoulder, while epaulets 38 and 40 provide additional protection for the trapezius muscle. The epaulets and shoulder caps are formed of substantially rigid material, and permit the use of increased force of contact against other players. Shoulder caps 34, 36 are hingedly attached to the outer shell to provide the athlete with a certain degree of freedom of movement. Padding 42 is included to cushion the outer shoulder from the hard surface of the shoulder cap.

Turning specifically to FIGS. 2 and 3, shoulder pad assembly 10 includes cantilever support 44 extending between plate portions 22 and 26. The cantilever support holds arched portion 18 above the shoulder, substantially reducing the impact of outer shell 12 on the shoulder during physical contact between players or against the ground. To evenly support the horizontally disposed arched portion regardless of the shape of the shoulders, the cantilever support of the present invention is self-adjusted to the slope of the trapezius muscle. Providing an adjustable cantilever support enables athletes having over-developed muscles to comfortably wear shoulder pad assembly 10 while playing football or participating in other contact sports.

In the illustrated embodiment, cantilever support 40 consists of first and second straps 46 and 48. One end of each strap is secured to back plate portion 26, while the other end is firmly attached to swivel plate 50 secured to front plate portion 22 by means of a pivot pin 51. By pivoting the swivel plate, the arch of first strap 42 may be increased in height while that of second strap 44 is decreased. Increasing the arch height of one strap and decreasing the other provides a cantilever support which follows the slope of the trapezius muscle.

If a player has an average body shape the arches defined by each of, straps 46 and 48 will be similar in height. For the athlete with substantially developed upper body muscles, the arch of the first strap will be increased, conforming to the greater height of the shoulder at that position. The arch of the second strap is shortened to accommodate the shape of the shoulder. Since the straps may be adjusted to fit the slope of the trapezius muscle, the generally horizontally disposed arched portion may be evenly supported on the shoulder.

Turning specifically to FIG. 3, cantilever support 44 is shown with swivel plate 50 pivoted to illustrate the positioning of the straps when shoulder pad assembly 10 is worn by an athlete having a substantially developed trapezius muscle. First strap 46 has a greater arch height than second strap 48, conforming to the slope of the shoulder. When a force is applied to outer shell 12, pushing the outer shell towards the shoulders, the first and second straps will evenly support the rigid shell above the shoulders. The force of impact will be partially absorbed by the padding. Since the straps have been adjusted to accommodate the slope of the shoulders, the force of impact is transferred through both straps 46 and 48 to the shoulders. Thus, with cantilever support 44 of the present invention, rigid outer shell 12 is evenly supported above the shoulder independent of the slope of the trapezius muscle.

As is shown in FIG. 2, first and second straps 46 and 48 are separated by a gap 52. The gap is of sufficient width to span the acromioclavicular joint of the shoulder. When shoulder pad assembly 10 is worn by an athlete, the straps are positioned on either side of the acromioclavicular joint. The impact of externally applied forces is transferred from outer shell 12 through straps 46 and 48 to the shoulder. Since the straps do not cover the acromioclavicular joint, the joint is isolated from the impact of the outer shell. Transferring the forces from the outer shell to an area of the shoulder remote from the acromioclavicular joint effectively protects the joint from injury. Thus, the cantilever support of the present invention will substantially protect the acromioclavicular joint from injury when the shoulder pad assembly is worn by athletes having either an average or an over-developed body shape.

Figure 4:
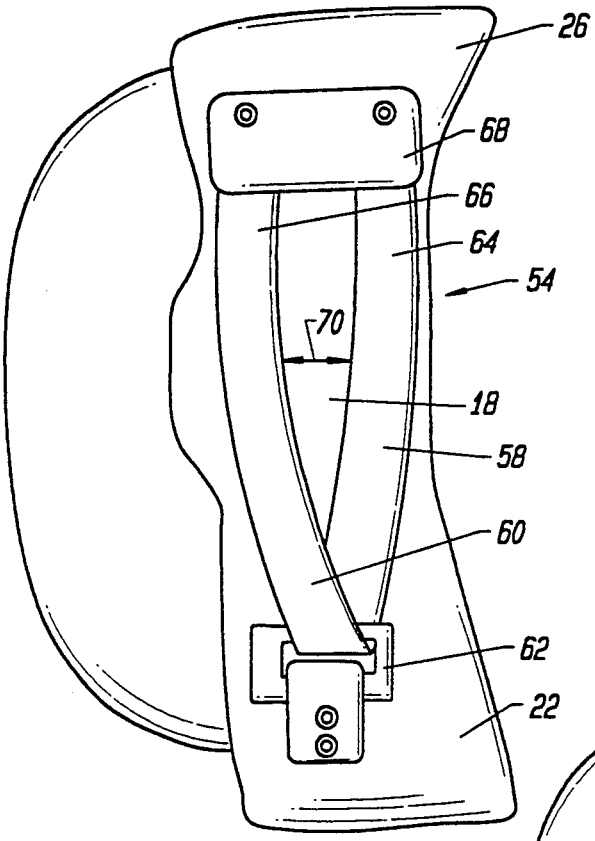
FIG. 4 is a bottom plan view showing another embodiment of cantilever support of a shoulder pad assembly in accordance with the present invention.

An alternative embodiment of the present invention is illustrated in FIG. 4. Cantilever support 54 includes strap 56 divided into first and second strap portions 58 and 60 by adjustment ring 62. First and second ends 64 and 66 are attached to mounting piece 68 which is firmly secured to back plate portion 26. The adjustment ring is positioned on strap 56 and is secured to chest plate portion 22. The first and second strap portions extend between the plate portions and support arched portion 18 above the shoulder.

Strap 58 slides through adjustment ring 62 to lengthen one of the strap portions while shortening the other, increasing the arch height of one while decreasing that of the other to automatically adjust the cantilever support to the shape of the shoulder. For a player having the average body shape, first and second body portions 58 and 60 will be of approximately the same length. On the other hand, if the athlete's muscles are over-developed, first strap portion 58 may be lengthened and second strap portion 60 shortened to follow the slope of the trapezius muscle.

A gap 70 having sufficient width to span the acromioclavicular joint separates the first and second strap portions. When shoulder pad assembly 10 is placed on the shoulders, strap portions 58 and 60 are positioned on either side of the joint. The acromioclavicular joint is thereby isolated from the impact of forces applied to outer shell 12. The strap portions transfer the force of impact to an area of the shoulder remote from the joint, preventing substantial injury.

Figure 5:
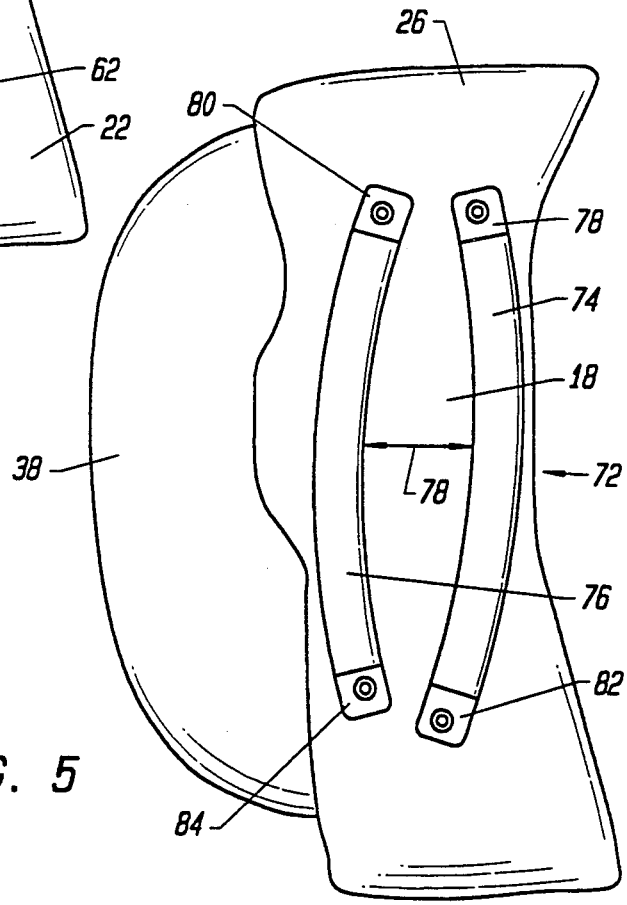
FIG. 5 is a bottom plan view showing yet another embodiment of a cantilever support of a shoulder pad assembly in accordance with the present invention.

Turning to FIG. 5, yet another embodiment of the present invention is disclosed. Cantilever support 72 consists of first and second cantilever straps 74 and 76. In the preferred form, only two straps are included; however, additional straps may be added if desired. One end 78, 80 of each strap is firmly attached to chest plate portion 22, while the other end 82, 84 of each is secured to back plate portion 26. The straps extend between the plate portions, supporting the horizontally disposed arched portion 18 above the shoulder independent of its slope.

In the present embodiment, the shoulder pad assembly is custom made for an individual athlete. The length, or arch height, of each strap is determined using the measurements of the slope of the athlete's shoulder. For an athlete with over-developed muscles, first strap 74 will have a higher arch than second strap 76 such that in edge view the straps 74 and 76 appear as straps 44 and 46 in FIG. 3. The actual height of the arch of the straps 74 and 76 is dependent upon the extent of the athlete's muscle development. Since the cantilever support has been specially assembled to conform to the particular size of the trapezius muscle, outer shell 12 is evenly supported above the shoulders.

As with the previously described embodiments, first and second straps 74 and 76 are separated by a gap 78 having sufficient width to span the acromioclavicular joint. With the shoulder pad assembly properly positioned on the shoulders, the impact of forces applied to the outer shell is isolated from the joint, preventing injury. The straps transfer the force of impact to an area of the shoulder remote from the acromioclavicular joint.

The cantilever support and shoulder pad assembly of the present invention protect the shoulders and upper body of an athlete. By increasing the arch height of one strap portion while shortening the other, the cantilever support effectively supports the rigid outer shell above the shoulders. The strap portions are properly positioned on the player's shoulders, allowing the cantilever to effectively support the rigid outer shell while protecting the acromioclavicular joint from injury. The shoulder pad assembly is more comfortable for the player, since the cantilever support conforms to the slope of the athlete's shoulders and does not overly press into the trapezius muscle.

What is claimed is:

1. A shoulder pad assembly for protecting the upper body and shoulders, said shoulders each having an acromioclavicular joint and a trapezius muscle extending between the neck and said acromioclavicular joint, said assembly comprising:

a substantially rigid outer shell having left and right body members, said body members each having a generally horizontally disposed arched portion for spanning one of said shoulders, said arched portion having an inner surface, said body members further having a chest plate portion and a back plate portion depending from said arched portion; and cantilever means extending between said plate portions for holding said arched portion above said shoulders to substantially reduce the impact of said outer shell on said shoulders when said outer shell is pressed onto said shoulders by the application of external forces to said outer shell, said cantilever means being configured for supporting said outer shell above said trapezius muscle such that, when said trapezius muscle is substantially developed forming a sloped surface between said neck and said acromioclavicular joint, the generally horizontally disposed arched portion is evenly supported on said trapezius muscle by said cantilever means, said cantilever means including at least two strap portions extending between said plate portions, said strap portions each defining an arch for receiving a portion of said shoulders, said arch of one of said strap portions being adjustable relative to said arch of another of said strap portions for adapting said cantilever means to the slope of said trapezius muscle.

2. A shoulder pad assembly for protecting the upper body and shoulders, said shoulders each having an acromioclavicular joint and a trapezius muscle extending between the neck and said acromioclavicular joint, said assembly comprising:

a substantially rigid outer shell having left and right body members, said body members each having a generally horizontally disposed arched portion for spanning one of said shoulders, said arched portion having an inner surface, said body members further having a chest plate portion and a back plate portion depending from said arched portion; and cantilever means extending between said plate portions for holding said arched portion above said shoulders to substantially reduce the impact of said outer shell on said shoulders when said outer shell is pressed onto said shoulders by the application of external forces to said outer shell, said cantilever means being configured for supporting said outer shell above said trapezius muscle such that, when said trapezius muscle is substantially developed forming a sloped surface between said neck and said acromioclavicular joint, the generally horizontally disposed arched portion is evenly supported on said trapezius muscle by said cantilever means, said cantilever means including first and second strap portions each defining an arch for receiving a portion of said shoulders and means for increasing the height of said arch of one of said strap portions while decreasing the height of said arch of the other of said portions.

3. A shoulder pad assembly as defined in claim 2 wherein each of said strap portions comprises a strap, one end of each of said straps being secured to one of said plate portions, the other end being mounted to a swivel plate secured to the other of said plate portions, said swivel plate being pivotable for adjustment of the height of said arch of said straps relative to said shoulders to support said outer shell above said shoulders independent of the slope of said shoulders.

4. A shoulder pad assembly as defined in claim 2 wherein said first and second strap portions comprise a strap having first and second ends and an adjustment ring positioned on said strap, said adjustment ring separating said strap into said first and second strap portions, said adjustment ring being secured to one of said plate portions, said first and second ends being secured to the other of said plate portions whereby said strap portions are positioned to extend across one of said shoulders, said strap being slidable through said adjustment ring for adjusting the height of said arch of said strap portions relative to said shoulders to support said outer shell above said shoulders independent of the slope of said shoulders.

5. A shoulder pad assembly for protecting the upper body and shoulders, said shoulders each having an acromioclavicular joint and a trapezius muscle extending between the neck and said acromioclavicular joint, said assembly comprising:

a substantially rigid outer shell having left and right body members, said body members each having a generally horizontally disposed arched portion for spanning one of said shoulders, said arched portion having an inner surface, said body members further having a chest plate portion and a back plate portion depending from said arched portion; and cantilever means extending between said plate portions for holding said arched portion above said shoulders to substantially reduce the impact of said outer shell on said shoulders when said outer shell is pressed onto said shoulders by the application of external forces to said outer shell, said cantilever means being configured for supporting said outer shell above said trapezius muscle such that, when said trapezius muscle is substantially developed forming a sloped surface between said neck and said acromioclavicular joint, the generally horizontally disposed arched portion is evenly supported on said trapezius muscle by said cantilever means, said cantilever means comprising at least two straps each having a first end secured to said chest plate portion and a second end secured to said back plate portion, said straps having a spacing therebetween, said straps conforming to the shape of said trapezius muscle.

6. A shoulder pad assembly as defined in claim 2 wherein said cantilever means is configured for transferring externally applied forces from said outer shell to an area of said shoulders remote from said acromioclavicular joint.

7. A shoulder pad assembly as defined in claim 2 and including padding attached to at least one of said inner surface and said cantilever means for protecting said shoulders and said upper body by reducing the impact of forces applied to said outer shell.

8. A shoulder pad assembly for protecting the upper body and shoulders, said shoulders having an acromioclavicular joint and a trapezius muscle extending between the neck and said acromioclavicular joint, said assembly comprising:

a substantially rigid outer shell having left and right body members, said body members each having an arched portion for spanning one of said shoulders, said arched portion having an inner surface, said body members further having a chest plate portion and a back plate portion depending from said arched portion; and cantilever means extending between said plate portions for supporting said arched portion above said shoulders to substantially reduce the impact of said outer shell on said shoulders when said outer shell is pressed downward onto said shoulders by the application of external forces to said outer shell, said cantilever means including at least two strap portions having a spacing therebetween such that when forces are applied to said outer shell, said at least two strap portions transfer the externally applied forces from said outer shell to an area of said shoulders remote from said acromioclavicular joint.

9. A shoulder pad assembly for protecting the upper body and shoulders, said shoulders having an acromioclavicular joint and a trapezius muscle extending between the neck and said acromioclavicular joint, said assembly comprising:

a substantially rigid outer shell having left and right body members, said body members each having an arched portion for spanning one of said shoulders, said arched portion having an inner surface, said body members further having a chest plate portion and a back plate portion depending from said arched portion; and cantilever means extending between said plate portions for supporting said arched portion above said shoulders to substantially reduce the impact of said outer shell on said shoulders when said outer shell is pressed downward onto said shoulders by the application of external forces to said outer shell, said cantilever means transferring the externally applied forces from said outer shell to an area of said shoulders remote from said acromioclavicular joint, said cantilever means including first and second strap sections each defining an arch for receiving a portion of said shoulders, and means for increasing the height of said arch of one of said strap portions while shortening said arch of the other of said strap portions.

10. A shoulder pad assembly as defined in claim 9 wherein said first and second strap portions comprise a strap having first and second ends and an adjustment ring positioned on said strap, said adjustment ring separating said strap into said first and second strap portions, said adjustment ring being secured to one of said plate portions, said first and second ends being secured to the other of said plate portions with said strap portions extending across one of said shoulders, said strap portions being separated by a gap of sufficient width to span said acromioclavicular joint.

11. A shoulder pad assembly as defined in claim 9 wherein each of said strap portions comprises a strap, one end of each of said straps being secured to one of said plate portions, the other end being mounted to a swivel plate secured to the other of said plate portions, said straps being separated by a distance of sufficient width to span said acromioclavicular joint.

12. A shoulder pad assembly for protecting the upper body and shoulders, said shoulders having an acromioclavicular joint and a trapezius muscle extending between the neck and said acromioclavicular joint, said assembly comprising:

a substantially rigid outer shell having left and right body members, said body members each having an arched portion for spanning one of said shoulders, said arched portion having an inner surface, said body members further having a chest plate portion and a back plate portion depending from said arched portion; and cantilever means extending between said plate portions for supporting said arched portion above said shoulders to substantially reduce the impact of said outer shell on said shoulders when said outer shell is pressed downward onto said shoulders by the application of external forces to said outer shell, said cantilever means transferring the externally applied forces from said outer shell to an area of said shoulders remote from said acromioclavicular joint, said cantilever means including at least two straps each having a first end secured to said chest plate portion and a second end secured to said back plate portion, said at least two straps being separated by a gap sufficiently wide to position said at least two straps on opposite sides of said acromioclavicular joint.

13. A shoulder pad assembly as defined in claim 9 wherein said arched portion is generally horizontally disposed, and said cantilever means are configured for supporting said outer shell above said trapezius muscle such that, when said trapezius muscle is substantially developed forming a sloped surface between said neck and said acromioclavicular joint, the generally horizontally disposed arched portion is evenly supported on said trapezius muscle by said cantilever means.

14. A shoulder pad assembly as defined in claim 9 and including padding attached to at least one of said inner surface and said cantilever means to substantially reduce the impact of forces applied to said outer shell.

15. A shoulder assembly for protecting the upper body and shoulders, said shoulders having an acromioclavicular joint and a trapezius muscle extending between the neck and said acromioclavicular joint, said assembly comprising:

a substantially rigid outer shell having left and right body members, said body members each having a generally horizontally disposed arched portion for spanning one of said shoulders, said arched portion having an inner surface, said body members further having a chest plate portion and a back plate portion depending from said arched portion;

first and second strap portions secured to said inner surface for supporting said outer shell above said shoulders to substantially reduce the impact of said outer shell on said shoulders when said outer shell is pressed onto said shoulders by the application of external forces to said outer shell, said first and second strap portions defining an arch for receiving said shoulders; and means for increasing the height of said arch of one of said strap portions while shortening said arch of the other of said strap portions such that, when said trapezius muscle is substantially developed forming a sloped surface from said neck to said acromioclavicular joint, the generally horizontally disposed arched portion is evenly supported on said trapezius muscle by said strap portions.

16. A shoulder pad assembly as defined in claim 15 wherein each of said strap portions comprises a strap, one end of each strap being mounted to a swivel plate secured to one of said plate portions and the other end being secured to the other of said plate portions, said swivel plate pivoting to adjust the height of said arch of at least one of said strap portions relative to said shoulders to support said outer shell above said shoulders independent of the slope of the shoulders.

17. A shoulder pad assembly as defined in claim 16 wherein said straps are separated by a gap of sufficient width to provide for the positioning of said straps on said shoulders on either side of said acromioclavicular joint.

18. A shoulder pad assembly as defined in claim 15 wherein said first and second strap portions comprise a strap having first and second ends and an adjustment ring positioned on said strap, said adjustment ring separating said strap into said first and second strap portions, said adjustment ring being pivotably secured to one of said plate portions, said first and second ends being secured to the other of said plate portions with said strap portions extending between said plate portions, said strap being slidable through said adjustment ring to adjust the height of said arch of at least one of said strap portions relative to said shoulders to support said outer shell above said shoulders independent of the slope of said shoulders.

19. A shoulder pad assembly as defined in claim 18 wherein said strap portions are separated by a gap having sufficient width to provide for the positioning of said strap portions on said shoulders on either side of said acromioclavicular joint.

20. A shoulder pad assembly for protecting the upper body and shoulders, said shoulders having an acromioclavicular joint and a trapezius muscle extending between the neck and said acromioclavicular joint, said assembly comprising:

a substantially rigid outer shell having left and right body members, said body members each having a generally horizontally disposed arched portion for spanning said shoulders, said arched portion having an inner surface, said body members further having a chest plate portion and a back plate portion depending from said arched portion; and at least two cantilever straps each having a first end secured to one of said plate portions and a second end mounted to a swivel plate secured to the other of said plate portions, said straps each defining an arch for receiving a portion of said shoulders, said swivel plate being pivotable to adjust the height of said arch of at least one of said straps relative to said shoulders such that, when said trapezius muscle is substantially developed forming a sloped surface between said neck and said acromioclavicular joint, the generally horizontally disposed arched portion is evenly supported on said trapezius muscle by said at least two cantilever straps.

21. A shoulder pad assembly as defined in claim 20 wherein said straps are separated by a gap of sufficient width to provide for the positioning of said at least two cantilever straps on said shoulders on either side of said acromioclavicular joint, said straps transferring externally applied forces from said outer shell to an area of said shoulder remote from said acromioclavicular joint.

22. A shoulder pad assembly for protecting the upper body and shoulders, said shoulders having an acromioclavicular joint and a trapezius muscle extending between the neck and said acromioclavicular joint, said assembly comprising:

a substantially rigid outer shell having left and right body members shaped for placement of said shoulders, said body members each having a generally horizontally disposed arched portion for spanning one of said shoulders, said arched portion having and an inner surface, said body members further having a chest plate portion and a back plate portion depending from said arched portion; and a cantilever strap having first and second ends and an adjustment ring positioned on said strap, said adjustment ring separating said strap into first and second strap portions each defining an arch for receiving a portion of said shoulders, said adjustment ring being secured to one of said plate portions, said first and second ends being secured to the other of said plate portions with said strap portions extending between said plate portion to support said outer shell above said shoulders, said strap being slidable through said adjustment ring to adjust the height of said arch of at least one of said strap portions relative to said shoulders such that, when said trapezius muscle is substantially developed forming a sloped surface between said neck and said acromioclavicular joint, the generally horizontally disposed arched portion is evenly supported on said trapezius muscle by said strap portions.

23. A shoulder pad assembly as defined in claim 22 wherein said strap portion are separated by a gap of sufficient width to provide for positioning of said strap portions on said shoulders on either side of said acromioclavicular joint, said strap portions transferring externally applied forces from said outer shell to an area of said shoulder remote from said acromioclavicular joint.

* * * * *